US007693438B2

(12) United States Patent
Kyung

(10) Patent No.: US 7,693,438 B2
(45) Date of Patent: Apr. 6, 2010

(54) IMAGE TRANSFER DEVICE, IMAGE FORMING APPARATUS HAVING THE IMAGE TRANSFER DEVICE, AND METHOD OF MEASURING RESISTANCE OF A PRINTING MEDIUM OR AN ENDLESS TRACK BELT OF THE IMAGE FORMING APPARATUS

(75) Inventor: Myung-ho Kyung, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 285 days.

(21) Appl. No.: 11/746,274

(22) Filed: May 9, 2007

(65) Prior Publication Data

US 2008/0063418 A1 Mar. 13, 2008

(30) Foreign Application Priority Data

Sep. 13, 2006 (KR) ..... 10-2006-0088607

(51) Int. Cl.
*G03G 15/16* (2006.01)
*G03G 15/00* (2006.01)

(52) U.S. Cl. ..... 399/66; 399/45

(58) Field of Classification Search ..... 399/45, 399/66, 389

See application file for complete search history.

(56) References Cited

U.S. PATENT DOCUMENTS

| | | | | |
|---|---|---|---|---|
| 6,111,594 | A * | 8/2000 | Jeong | 399/45 X |
| 6,493,523 | B2 * | 12/2002 | Weaver | 399/45 |
| 6,766,123 | B2 * | 7/2004 | Ebihara et al. | 399/66 |
| 2006/0045554 | A1 * | 3/2006 | Saeki | 399/66 |

* cited by examiner

*Primary Examiner*—Sandra L Brase
(74) *Attorney, Agent, or Firm*—Stanzione & Kim, LLP

(57) ABSTRACT

An image transfer device to accurately measure a resistance of a printing medium or a transfer belt, an image forming apparatus having the image transfer device, and a method of measuring the resistance of the printing medium. The image transfer device includes a conveyance unit, to which a reference voltage or current is applied, and which includes a first roller having variations of resistance along a circumferential direction, and a second roller to support the first roller, a transfer roller spaced apart from the first roller by a distance corresponding to at least the circumference of the first roller to transfer a developer agent of a photosensitive drum onto a printing medium, and a controller to measure resistance of the printing medium by detecting electric current or voltage difference between the first and the second rollers, and to supply the transfer roller with a transfer voltage or a current according to the detected resistance of the printing medium.

34 Claims, 4 Drawing Sheets

30

IMAGE TRANSFER DEVICE, IMAGE FORMING APPARATUS HAVING THE IMAGE TRANSFER DEVICE, AND METHOD OF MEASURING RESISTANCE OF A PRINTING MEDIUM OR AN ENDLESS TRACK BELT OF THE IMAGE FORMING APPARATUS

CROSS-REFERENCE TO RELATED APPLICATIONS

This application claims the benefit under 35 U.S.C. § 119 (a) of Korean Patent Application No. 2006-88607 filed on Sep. 13, 2006, in the Korean Intellectual Property Office, the entire disclosure of which is hereby incorporated by reference.

BACKGROUND OF THE INVENTION

1. Field of the Invention

The present general inventive concept relates to an image transfer device of an image forming apparatus. More particularly, the present general inventive concept relates to an image transfer device which accurately measures a resistance of a printing medium or an endless track belt, and an image forming apparatus having the same.

2. Description of the Related Art

A conventional laser beam printer includes an image forming means such as a paper cassette, a developing device and a fuser, and carries out a printing operation by attracting toner onto a paper sheet.

The operation of a laser beam printer can be mainly categorized into charging, writing, developing, transferring, and fusing. When charging, a charger is energized to a high voltage of approximately 7000V and forms a minus (−) charge on the surface of a photoconductor drum by a Corona discharge. When writing, a laser beam scans the surface of the photoconductor drum bearing the (−) charge so that a desired electrostatic latent image is formed according to the (−) charge pattern. When developing, a developing roller and photoconductor drum are rotated in intimate contact with each other so that toner particles of the (−) charge are attracted onto the electrostatic latent parts. When transferring, a transfer device is energized to a predetermined voltage and the other side of the paper sheet has a (+) charge so that toner particles of the (−) charge are attracted onto a paper sheet when the paper sheet is passed between the photoconductor drum and the transfer device. When fusing, the toner image is fixed into the paper sheet by appropriate heat and pressure. Accordingly, the paper sheet bearing the final image is released.

Meanwhile, each type of printing medium has a different resistance depending on the thickness, wetness, or quality, and the printing quality heavily depends on the resistance. An endless track belt also has a resistance which varies depending on manufacturing processes or use.

To prevent image quality degradation, a conventional image forming apparatus includes a roller which is connected with a resistance measuring circuit, so that a resistance of a paper sheet or an endless track belt can be measured and an associated transfer voltage can be transmitted to the transfer roller before an image transfer.

However, because there are different types of materials included in an inner side of a resistance measuring roller, resistance of the resistance measuring roller varies in the circumferential direction. A conventional image forming apparatus fails to reflect a potential varying resistance of the paper sheet or the endless track belt, because the interval between the resistance measuring roller and the transfer roller is shorter than the circumference of the resistance measuring roller, which means that the varying resistance in the circumferential direction of the resistance measuring roller is not completely considered.

SUMMARY OF THE INVENTION

The present general inventive concept provides a transfer device of an image forming apparatus, which measures a resistance of a printing medium accurately by reflecting a varying resistance in a circumferential direction of a resistance measuring roller.

The present general inventive concept also provides an image forming apparatus including a transfer device which measures the resistance of the printing medium with accuracy.

The present general inventive concept also provides a method of measuring the resistance of printing medium with accuracy.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept are achieved by providing an image transfer device of an image forming apparatus including a conveyance unit, to which a reference voltage or current is applied, and which includes a first roller and a second roller to support the first roller, a transfer roller spaced apart from the first roller by a distance corresponding to at least the circumference of the first roller to transfer a developer agent of a photosensitive drum onto a printing medium, and a controller to measure a resistance of the printing medium by detecting electric current or voltage difference between the first and the second rollers, and to supply the transfer roller with a transfer voltage or current according to the detected resistance of the printing medium.

The first roller may have variations of resistance along a circumferential direction. The first roller may be made of a conductive rubber. The second roller may be made of metal.

The controller may measure the resistance of the printing medium by incorporating at least once the variations of resistance in the circumferential direction of the first roller. The controller may obtain the resistance of the printing medium by dividing the reference voltage during at least one rotation by a current flowing through first and the second rollers.

The controller may obtain the resistance of the printing medium by dividing the reference voltage during at least one rotation of the first roller by a voltage between the first and the second rollers.

The foregoing and/or other aspects and utilities of the present general inventive concept may also be achieved by providing an image transfer device of an image forming apparatus, including a printing medium conveyance belt to run in an endless track with an exterior surface in a contact with as plurality of photosensitive drums and to convey a printing medium, a first and a second roller which supports the first roller, wherein a reference voltage or a current is received between the first and the second rollers, a plurality of transfer rollers which include a first transfer roller formed next to the first roller in the direction of conveyance by a distance which corresponds to at least a circumference of the first roller, the transfer rollers disposed in tandem with the photosensitive drums wherein the printing medium conveyance belt is interposed between the transfer rollers and the photosensitive drums, and a controller to detect a current or a voltage difference between the first and second rollers to measure resistance of the printing medium, and to supply the transfer roller with a transfer voltage or a current according to the measured resistance of the printing medium.

The first roller may have variations of resistance along a circumferential direction.

The first roller may include a printing medium moving roller to move the printing medium onto the printing medium conveyance belt. The printing medium moving roller may be made of a conductive rubber.

The second roller may be made of metal.

The controller may measure the resistance of the printing medium by incorporating at least once the variations of resistance in the circumferential direction of the first roller.

The controller may obtain the resistance of the printing medium by dividing a reference voltage during at least one rotation by an average current of the currents flowing through the first and the second rollers.

The controller may obtain the resistance of the printing medium by dividing a reference current during at least one rotation by a voltage between the first and the second rollers.

The foregoing and/or other aspects and utilities of the present general inventive concept may also be achieved by providing an image transfer device of an image forming apparatus, including an endless track belt which includes a first roller and a second roller to support the first roller, wherein a reference voltage, or current is received between the first and the second rollers, a transfer roller spaced apart from the first roller by a distance corresponding to at least the circumference of the first roller to transfer a developer agent of a photosensitive drum onto the endless track belt, and a controller to measure a resistance between the first and the second rollers by detecting an electric current or a voltage difference between the first and the second rollers, and to supply the transfer roller with a transfer voltage or a current according to the detected resistance.

The first roller may have variations of resistance along a circumferential direction.

The first roller or the second roller may be made of conductive rubber or metal.

The controller may measure the resistance between the first and the second rollers, by at least once incorporating variations of resistance in the circumferential direction of the first roller.

The controller may obtain the resistance between the first and the second rollers by dividing a reference voltage by a current flowing through the first and the second rollers during at least one rotation.

The controller may obtain the resistance between the first and the second rollers by dividing a reference voltage during at least one rotation by a voltage between the first and the second rollers.

The foregoing and/or other aspects and utilities of the present general inventive concept may also be achieved by providing an image forming apparatus, including a printing medium feeding device which picks up a printing medium and feeds the picked up printing medium to a conveyance path, a developing unit which develops an electrostatic latent image by attaching a developer agent onto the electrostatic latent image, one of the aforementioned image transfer devices, and a fusing device which fixes a developed image in the printing medium.

The foregoing and/or other aspects and utilities of the present general inventive concept may also be achieved by providing a method of measuring a resistance of a printing medium of an image forming apparatus, including supplying a reference voltage, or current to a first roller, detecting an average resistance of the first roller and a second roller which supports the first roller during at least one rotation of the first roller, detecting an average resistance between the first and the second rollers when the printing medium is passed between the first and the second rollers, during at least one rotation of the first roller, and obtaining a resistance of the printing medium by subtracting the average resistance of the first and the second rollers from the average resistance between the first and the second rollers.

The first roller may have variations of resistance along a circumferential direction.

The obtaining the average resistance between the first and the second rollers may include measuring electric currents between the first and the second rollers during at least one rotation of the first roller, and obtaining the resistance of the printing medium by applying Ohm's law to the average of the currents and the reference voltage.

The foregoing and/or other aspects and utilities of the present general inventive concept may also be achieved by providing a method of measuring a resistance of an endless track belt of an image forming apparatus, including supplying a reference voltage, or current to a first roller, detecting a resistance of the first roller and a second roller which supports the first roller during at least one rotation of the first roller, positioning the endless track belt between the first and the second rollers and detecting a resistance between the first and the second rollers during at least one rotation of the first roller, and obtaining a resistance of the endless track belt by subtracting the average resistance of the first and the second rollers from the average resistance between the first and the second rollers.

The first roller may have variations of resistance along a circumferential direction.

The foregoing and/or other aspects and utilities of the present general inventive concept may also be achieved by providing an image transfer device of an image forming apparatus, including a photosensitive drum on which an electrostatic latent image is formed, a transfer roller arranged in tandem with the photosensitive drum to convey a printing medium therebetween and to transfer developer onto the printing medium, a moving roller to move the printing medium to a position to be simultaneously conveyed by the photosensitive drum and the transfer roller after the moving roller completes at least one full rotation while maintaining contact with the printing medium, and a resistance measuring circuit to measure a total resistance of the printing medium after the at least one full rotation of the moving roller and to supply the transfer roller with a transfer voltage or current according to the measured resistance of the printing medium.

The total resistance of the printing medium may be measured by subtracting an average resistance of the moving roller during a first full rotation of the moving roller from an average resistance of the moving roller during a second full rotation of the moving roller.

The printing medium may be moved by the moving roller after the first full rotation.

The foregoing and/or other aspects and utilities of the present general inventive concept may also be achieved by providing a method of an image forming apparatus, the method including moving a printing medium from a moving roller to a position to be simultaneously conveyed by a photosensitive drum and a transfer roller after the moving roller completes at least one full rotation while maintaining contact with the printing medium, measuring a total resistance of the printing medium after the at least one full rotation of the moving roller, and supplying the transfer roller with a transfer voltage or current according to the measured resistance of the printing medium.

The total resistance of the printing medium may be measured by subtracting an average resistance of the moving roller during a first full rotation of the moving roller from an average resistance of the moving roller during a second full rotation of the moving roller.

The printing medium may be moved by the moving roller after the first full rotation.

The foregoing and/or other aspects and utilities of the present general inventive concept may also be achieved by providing an image transfer device of an image forming apparatus, including a feeding unit to feed a printing medium to be positioned between a photosensitive drum and a transfer roller, and a circuit to measure a resistance of the printing medium during an entire feeding of the printing medium, and to supply the transfer roller with a transfer voltage or current according to the measured resistance of the printing medium.

The entire feeding of the printing medium may include a time period during which a leading end of the printing medium enters the feeding unit and a trailing end exits the feeding unit.

The foregoing and/or other aspects and utilities of the present general inventive concept may also be achieved by providing a method of an image forming apparatus, including feeding a printing medium through a feeding device to position the printing medium between a photosensitive drum and a transfer roller, measuring a resistance of the printing medium during an entire feeding of the printing medium, and supplying the transfer roller with a transfer voltage or current according to the measured resistance of the printing medium.

The entire feeding of the printing medium may include a time period during which a leading end of the printing medium enters the feeding unit and a trailing end exits the feeding unit.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
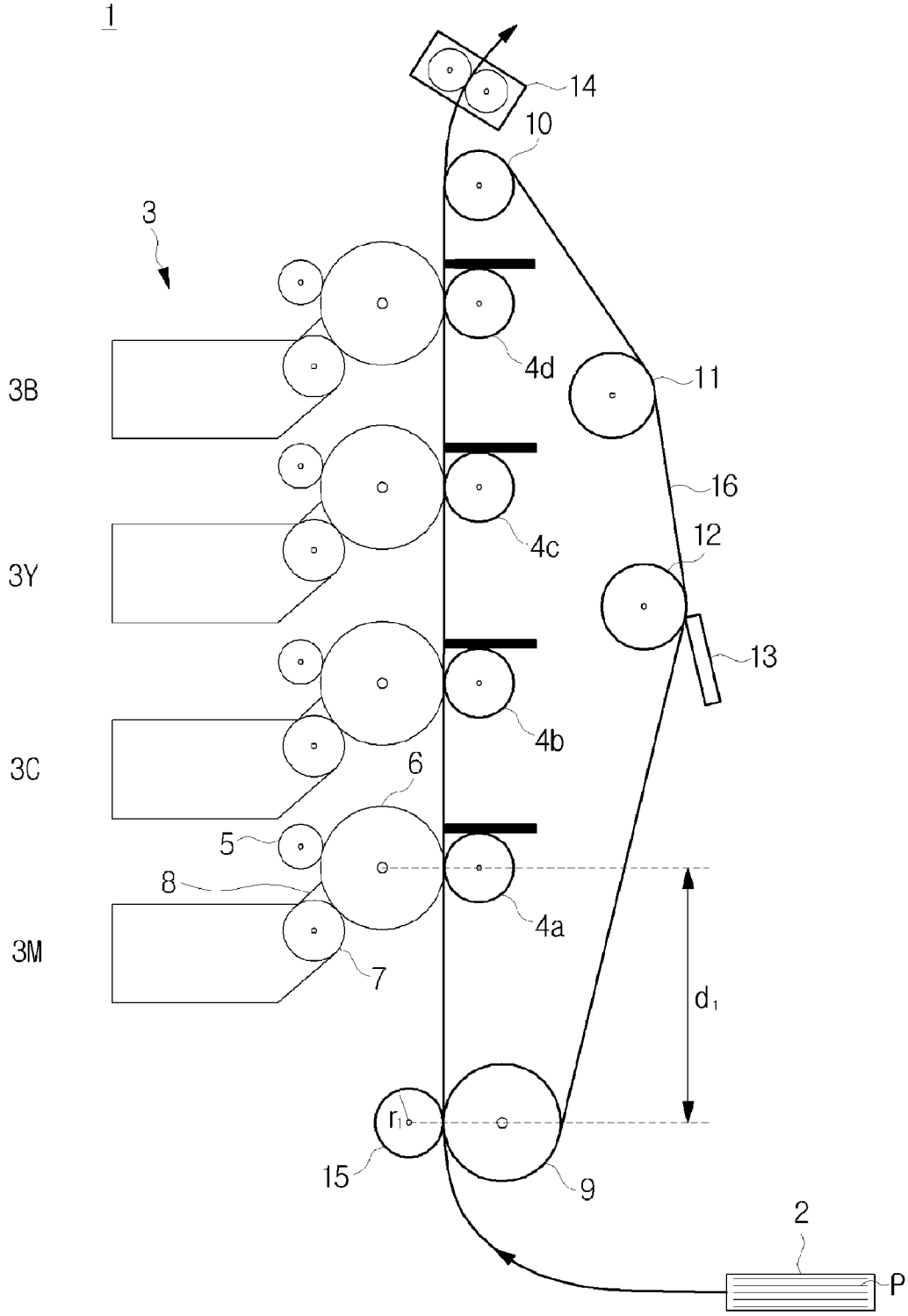
FIG. 1 is a schematic view illustrating a transfer device of a tandem image forming apparatus according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a schematic view illustrating a tandem type image forming apparatus according to an exemplary embodiment of the present general inventive concept.

Referring to FIG. 1, an image forming apparatus 1 may include a printing medium feeding unit 2, to feed a printing medium such as, for example, paper, four toner image forming units 3M, 3C, 3Y, 3B, four transfer rollers 4*a*, 4*b*, 4*c*, 4*d*, a conveyance belt 16 to circulate a printing medium P along the transfer rollers 4*a*, 4*b*, 4*c*, 4*d*, and a fusing unit 14.

The toner image forming units 3M, 3C, 3Y, 3B may form magenta (M), cyan (C), yellow (Y) and black (B) toner images, respectively, and each of the toner image forming units 3M, 3C, 3Y, 3B may include a laser scanning unit (not illustrated) to emit a laser beam, a photoconductor drum 6 which is charged by a charging roller 5 and on which an electrostatic latent image is written by the laser beam, a developing roller 7 to apply a developing agent onto the photoconductor drum 6, and a photoconductor drum cleaner 8.

The transfer rollers 4*a*, 4*b*, 4*c*, 4*d* are arranged in tandem with the photoconductor drums 6, respectively, and transfer the toner images of the photoconductor drums 6 onto a printing medium P. The conveyance belt 16 circulates along the transfer rollers 4*a*, 4*b*, 4*c*, 4*d*, and is supported by a second roller 9, a driven roller 10, a first tension roller 11, and a second tension roller 12. A first roller 15 is supported by the second roller 9, and positioned at the front side of the conveyance belt 16. A cleaner 13 is installed on one side of the endless track belt 16 to remove and collect waste remaining on the conveyance belt 16. The first roller 15 may be implemented as a printing medium moving roller to move the printing medium P onto the conveyance belt 16, and the second roller 9 may be implemented as a supporting roller to support the first roller 15.

The fusing unit 14 may include a plurality of rollers to thermally fuse the toner image in the printing medium P which is conveyed along the conveyance belt 16.

The first roller 15 may be made of conductive rubber material, and thus may include variations of resistance in a circumferential direction. The second roller 9 is formed on the inner portion of the conveyance belt 16 in a location corresponding to the first roller 15, to move the printing medium P between the first roller 15 and the conveyance belt 16.

The second roller 9 may be made of metal material, and thus may include negligible variations of resistance. A resistance between the first roller 15 and the second roller may be calculated by sending a reference voltage or a reference current to the first roller 15, measuring a current at the second roller 9 which supports the first roller 15, or measuring a voltage between the first roller 15 and the second roller 9, and applying Ohm's law.

A distance d1 between the first roller 15 and the first transfer roller 4*a*, which is located next to the first roller 15 in the direction of printing medium conveyance, is longer than a length ($2\pi r_1$, where $r_1$ is a radius of the first roller 15) of an outer circumference of the first roller 15 (i.e., $d_1 \geqq 2\pi r_1$).

Accordingly, a resistance of the printing medium P is calculated by applying all the variations in resistance along the outer circumference of the first roller 15 during one rotation of the first roller 15 to the printing medium P. As a result, an appropriate transfer voltage or current can be applied to the transfer rollers 4*a*, 4*b*, 4*c*, 4*d*.

Figure 2:
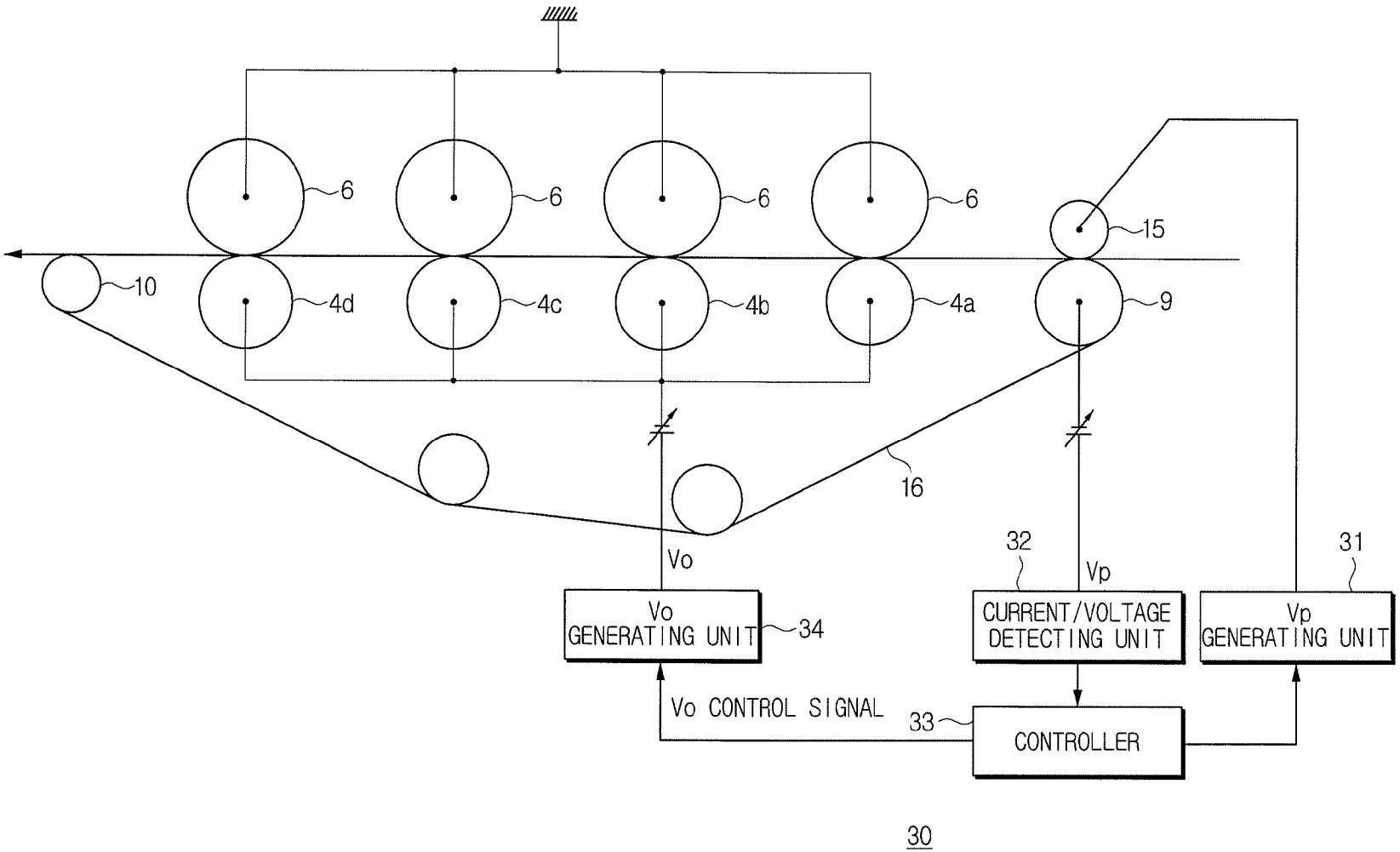
FIG. 2 is a diagram illustrating a resistance measuring circuit of the transfer device of FIG. 1 according to an exemplary embodiment of the present general inventive concept.

FIG. 2 illustrates a constant-voltage type resistance measuring circuit of the transfer device of FIG. 1, according to an exemplary embodiment of the present general inventive concept.

Referring to FIG. 2, a resistance measuring circuit 30 may include a Vp generating unit 31 to supply a reference voltage Vp between the first roller 15 and the second roller 9, a current/voltage detecting unit 32 to measure an electric current flowing through the second roller 9, or to measure a voltage or a resistance of the second roller 9, a controller 33 to measure a resistance of the printing medium P, and a Vo generating unit 34 to supply a transfer voltage Vo to the transfer rollers 4*a*, 4*b*, 4*c*, 4*d*.

When the printing medium P is passed between the first roller 15 and second roller 9, a current value or a voltage difference is generated in a proportion or an inverse proportion to the resistance of the printing medium P. The generated value may be variable according to the variations of resistance in the circumferential direction of the rotating first roller 15.

Figure 3:
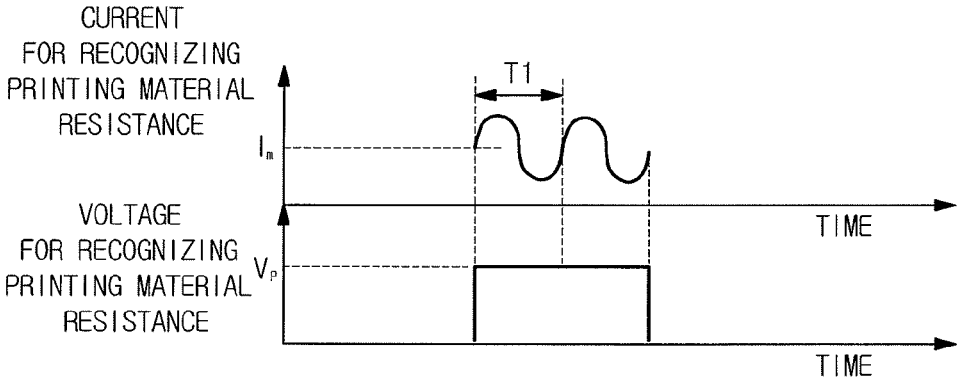
FIG. 3 is a graphical representation of electric currents of the transfer device of FIG. 1 according to an exemplary embodiment of the present general inventive concept.

Referring to the transfer device of FIGS. 1 and 2, FIG. 3 is a graphical representation of the electric current value flowing through the first roller 15 and the second roller 9 of FIGS. 1 and 2 when the voltage Vp is supplied between the first roller 15 and the second roller 9 via the Vp generating unit 31, according to an exemplary embodiment of the present general inventive concept.

Referring to FIG. 3, the detected current periodically varies according to the rotation of the first roller 15, due to the variations of resistance in the circumferential direction of the first roller 15. According to the Ohm's law, the resistance of the first roller 15 can be obtained by dividing the reference voltage Vp by an average current Im of a period $T_1$.

A process of obtaining the resistance of the printing medium P is explained below.

A first average resistance $R_1$ of the first roller 15 and the second roller 9 may be detected during at least one rotation of the first roller 15. A second average resistance $R_2$ of the first roller 15 and the second roller 9 may be obtained during at least one rotation of the first roller 15, when the printing medium P is passed between the first roller 15 and the second roller 9. A third average resistance Rp of the printing medium P may be obtained by subtracting $R_1$ from $R_2$.

The average resistance during at least one rotation of the first roller 15 can be obtained by applying Ohm's law, using the average current Im of the first roller 15 and the second roller 9 and the voltage Vp.

Figure 4:
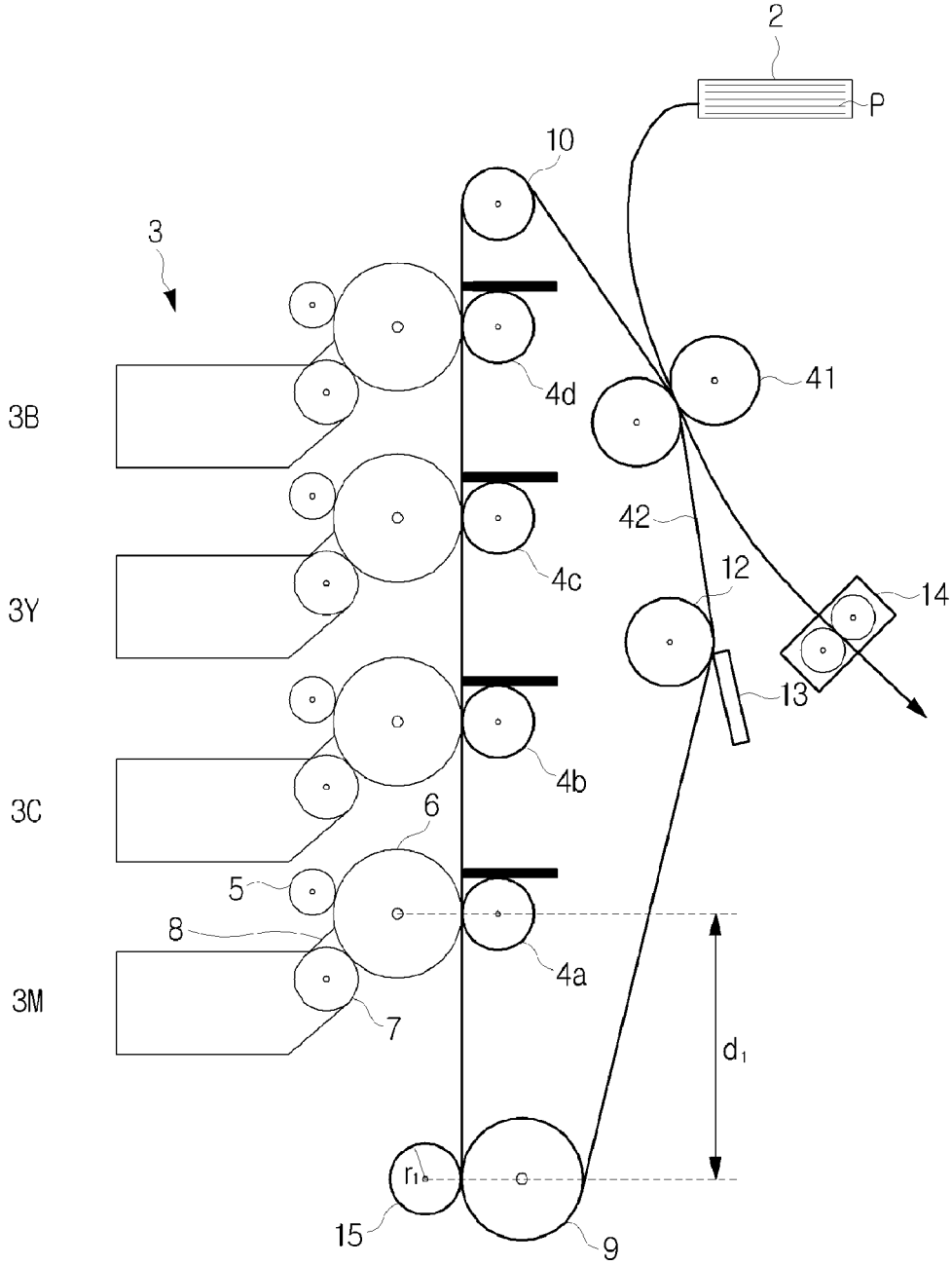
FIG. 4 is a schematic view illustrating a transfer device of an intermediate transfer type image forming apparatus according to an exemplary embodiment of the present general inventive concept.

FIG. 4 illustrates an intermediate transfer type image forming apparatus according to another exemplary embodiment of the present general inventive concept.

Referring to FIG. 4, the image forming apparatus uses an endless track belt such as a transfer belt 42 to substitute the printing medium conveyance belt 16 of FIG. 1, and additionally includes a printing medium transfer roller 41 on an outer side of the transfer belt 42. A printing medium P is passed between the transfer belt 42 and the transfer roller 41. Accordingly, the transfer belt 42 circulates in a paper feeding direction, and developer agents of respective colors are transferred onto the transfer belt 42 according to color electrostatic latent images as the transfer belt 42 runs along first to fourth transfer rollers 4*a*, 4*b*, 4*c*, 4*d*, respectively. Developed images are subsequently transferred onto the printing medium P as it passes through the printing medium transfer roller 41.

Transfer voltages of the first to fourth transfer rollers 4*a*, 4*b*, 4*c*, 4*d* may be controlled according to a resistance of the transfer belt 41. A distance $d_1$ between the first roller 15 and the first transfer roller 4*a* may be longer than at least the length ($2\pi_1$ where $r_1$ is a radius of the first roller 15) of an outer circumference of the first roller 15 (i.e., $d_1 \geqq 2\pi r_1$). The resistance of the transfer belt 41 may be obtained by a similar process as explained above, to reflect variations of resistance of the first roller 15. Accordingly, the resistance of the transfer belt 41 may be obtained by supplying a reference voltage between the first roller 15 which has resistance variations in a circumferential direction and the second roller 9 which supports the first roller 15, detecting an average resistance R3 of the first roller 15 and the second roller 9 during one rotation of the first roller 15, positioning the transfer belt 42 between the first roller 15 and the second roller 9, and detecting an average resistance R4 between the first roller 15 and the second roller 9 during at least one rotation of the first roller 15 and subtracting the average resistance R3 from the average resistance R4 to obtain a resistance Rb of the transfer belt 42.

The average resistances $R_3$ and $R_4$ can be obtained with the resistances that are measured during the at least one rotation of the first roller 15. The average resistances $R_3$ and $R_4$ may be obtained by applying Ohm's law, using an average current Im and the reference voltage Vp between the first roller 15 and the second roller 9.

Alternatively, a constant-current type resistance measurement may be employed. A constant-current type transfer device may be configured in the same manner as the above constant-voltage type transfer device of FIG. 4, in which the distance $d_1$ between the first roller 15 and the first transfer roller 4*a* next to the first roller 15 in the direction of paper conveyance, is longer than at least the length of the outer circumference $2l\pi r_1$ of the first roller 15. In the constant-current type transfer device, a resistance value reflecting all the resistance variations along the outer circumference of the first roller 15 is obtained by sending a reference current to the first roller 15 in at least one rotation of the first roller 15, measuring a voltage between the first roller 15 and the second roller 9 and applying Ohm's law. A resistance of a paper sheet is then calculated in the same manner as in the constant-voltage type resistant measurement, and thus an appropriate transfer voltage or transfer current is applied to the transfer rollers 4*a*, 4*b*, 4*c*, 4*d*, respectively.

The present general inventive concept will not be construed as limited to the above exemplary embodiments, and one in the art may apply the present general inventive concept to various tandem type image forming apparatus, or an image forming apparatus using a single developing cartridge.

According to the exemplary embodiments of the present general inventive concept, a resistance of a printing medium or a transfer belt can be measured with accuracy, by completely incorporating variations of resistances along a circumferential direction of a resistance measuring roller. As a result, an appropriate transfer voltage can be supplied to the transfer roller, which will subsequently improve image quality.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image transfer device of an image forming apparatus, comprising:

a conveyance unit, to which a reference voltage or current is applied, and which comprises a first roller, and a second roller to support the first roller;

a transfer roller spaced apart from the first roller by a distance corresponding to at least the circumference of the first roller to transfer a developer agent of a photosensitive drum onto a printing medium; and a controller to measure a resistance of the printing medium by detecting an electric current or voltage difference between the first and second roller, and to supply the transfer roller with a transfer voltage or current according to the detected resistance of the printing medium;

wherein the first roller has variations of resistance along a circumferential direction.

2. The image transfer device of claim 1, wherein the first roller is made of a conductive rubber.

3. The image transfer device of claim 1, wherein the second roller is made of metal.

4. The image transfer device of claim 1, wherein the controller measures the resistance of the printing medium by incorporating at least once the variations of resistance in the circumferential direction of the first roller.

5. The image transfer device of claim 1, wherein the controller obtains the resistance of the printing medium by dividing the reference voltage during at least one rotation by a current flowing through the first and second roller.

6. The image transfer device of claim 1, wherein the controller obtains the resistance of the printing medium by dividing the reference voltage during at least one rotation of the first roller by a voltage between the first and second roller.

7. An image transfer device of an image forming apparatus, comprising:

a printing medium conveyance belt to run in an endless track with an exterior surface in a contact with as plurality of photosensitive drums, and to convey a printing medium;

a first roller and a second roller to support the first roller, wherein a reference voltage or current is received between the first and second roller;

a plurality of transfer rollers which comprise a first transfer roller formed next to the first roller in a direction of conveyance by a distance which corresponds to at least a circumference of the first roller, the transfer rollers disposed in tandem with the photosensitive drums wherein the printing medium conveyance belt is interposed between the transfer rollers and the photosensitive drums; and a controller to detect a current difference or a voltage difference between the first and second rollers to measure a resistance of the printing medium, and to supply the transfer roller with a transfer voltage or a current according to the measured resistance of the printing mediums;

wherein the first roller has variations of resistance along a circumferential direction.

8. The image transfer device of claim 7, wherein the first roller comprises a printing medium moving roller to move the printing medium onto the printing medium conveyance belt.

9. The image transfer device of claim 8, wherein the printing medium moving roller is made of a conductive rubber.

10. The image transfer device of claim 7, wherein the second roller is made of metal.

11. The image transfer device of claim 7, wherein the controller measures the resistance of the printing medium by incorporating at least once variations of resistance in the circumferential direction of the first roller.

12. The image transfer device of claim 7, wherein the controller obtains the resistance of the printing medium by dividing a reference voltage during at least one rotation by an average current of the currents flowing through first and second roller.

13. The image transfer device of claim 7, wherein the controller obtains the resistance of the printing medium by dividing a reference current during at least one rotation by a voltage between the first and second roller.

14. An image forming apparatus, comprising:

a printing medium feeding device to pick up a printing medium and feed the picked up printing medium to a conveyance path;

a developing unit to develop an electrostatic latent image by attaching a developer agent onto the electrostatic latent image;

an image transfer device comprising:

a conveyance unit, to which a reference voltage or current is applied, and which comprises a first roller having variations of resistance along a circumferential direction, and a second roller to support the first roller, a transfer roller spaced apart from the first roller by a distance corresponding to at least the circumference of the first roller to transfer a developer agent of a photosensitive drum onto a printing medium, and a controller to measure a resistance of the printing medium by detecting electric current or voltage difference between the first and second roller, and to supply the transfer roller with a transfer voltage or a current according to the detected resistance of the printing medium; and a fusing device to fix a developed image in the printing medium.

15. A method of measuring a resistance of a printing medium of an image forming apparatus, the method comprising:

supplying a reference voltage or current to a first roller;

detecting an average resistance of the first roller and a second roller to support the first roller during at least one rotation of the first roller;

detecting an average resistance between the first and second roller when the printing medium is passed between the first and the second roller, during at least one rotation of the first roller; and obtaining a resistance of the printing medium by subtracting the average resistance of the first and second roller from the average resistance between the first and second roller.

16. The method of claim 15, wherein the first roller has variations of resistance along a circumferential direction.

17. The method of claim 15, wherein the obtaining the average resistance between the first and second roller comprises:

measuring electric currents between the first and the second rollers during at least one rotation of the first roller; and obtaining the resistance of the printing medium by applying Ohm's law to the average of the currents and the reference voltage.

18. An image transfer device of an image forming apparatus, comprising:

an endless track belt which comprises a first roller and a second roller to support the first roller, wherein a reference voltage or current is received between the first and second roller;

a transfer roller spaced apart from the first roller by a distance corresponding to at least the circumference of the first roller to transfer a developer agent of a photosensitive drum onto the endless track belt; and a controller to measure a resistance between the first and second roller by detecting an electric current or voltage difference between the first and the second rollers, and to supply the transfer roller with a transfer voltage or current according to the detected resistance;

wherein the first roller has variations of resistance along a circumferential direction.

19. The image transfer device of claim 18, wherein the first roller or the second roller is made of a conductive rubber or metal.

20. The image transfer device of claim 18, wherein the controller measures the resistance between the first and the second rollers, by at least once incorporating variations of resistance in the circumferential direction of the first roller.

21. The image transfer device of claim 18, wherein the controller obtains the resistance between the first and the second rollers by dividing a reference voltage by a current flowing through the first and second roller during at least one rotation.

22. The image transfer device of claim 18, wherein the controller obtains the resistance between the first and the second rollers by dividing a reference voltage during at least one rotation by a voltage between the first and second roller.

23. A method of measuring a resistance of an endless track belt of an image forming apparatus, the method comprising:

supplying a reference voltage, or current to a first roller;

detecting a resistance of the first roller and a second roller which supports the first roller during at least one rotation of the first roller;

positioning the endless track belt between the first and second roller and detecting a resistance between the first and second roller during at least one rotation of the first roller; and obtaining a resistance of the endless track belt by subtracting the average resistance of the first and second roller from the average resistance between the first and second roller.

24. The method of claim 23, wherein the first roller has variations of resistance along a circumferential direction.

25. An image transfer device of an image forming apparatus, comprising:

a photosensitive drum on which an electrostatic latent image is formed;

a transfer roller arranged in tandem with the photosensitive drum to convey a printing medium therebetween and to transfer developer onto the printing medium;

a moving roller to position the printing medium between the photosensitive drum and the transfer roller after the moving roller completes at least one full rotation while maintaining contact with the printing medium; and a resistance measuring circuit to measure a total resistance of the printing medium after the at least one full rotation of the moving roller and to supply the transfer roller with a transfer voltage or current according to the measured resistance of the printing medium.

26. The image transfer device of claim 25, wherein the total resistance of the printing medium is measured by subtracting an average resistance of the moving roller during a first full rotation of the moving roller from an average resistance of the moving roller during a second full rotation of the moving roller.

27. The image transfer device of claim 25, wherein the printing medium is moved by the moving roller after the first full rotation.

28. A method of an image forming apparatus, comprising:

moving a printing medium from a moving roller to a position to be simultaneously conveyed by a photosensitive drum and a transfer roller after the moving roller completes at least one full rotation while maintaining contact with the printing medium;

measuring a total resistance of the printing medium after the at least one full rotation of the moving roller; and supplying the transfer roller with a transfer voltage or current according to the measured resistance of the printing medium.

29. The method of claim 28, wherein the total resistance of the printing medium is measured by subtracting an average resistance of the moving roller during a first full rotation of the moving roller from an average resistance of the moving roller during a second full rotation of the moving roller.

30. The method of claim 29, wherein the printing medium is moved by the moving roller after the first full rotation.

31. An image transfer device of an image forming apparatus, comprising:

a feeding unit to feed a printing medium to be positioned between a photosensitive drum and a transfer roller; and a circuit to measure a resistance of the printing medium during an entire feeding of the printing medium and to supply the transfer roller with a transfer voltage or current according to the measured resistance of the printing medium.

32. The image transfer device of claim 31, wherein the entire feeding of the printing medium includes a time period during which a leading end of the printing medium enters the feeding unit and a trailing end exits the feeding unit.

33. A method of an image forming apparatus, comprising:

feeding a printing medium through a feeding device to position the printing medium between a photosensitive drum and a transfer roller;

measuring a resistance of the printing medium during an entire feeding of the printing medium; and supplying the transfer roller with a transfer voltage or current according to the measured resistance of the printing medium.

34. The method of claim 33, wherein the entire feeding of the printing medium includes a time period during which a leading end of the printing medium enters the feeding unit and a trailing end exits the feeding unit.

* * * * *